US005879240A

United States Patent [19]

Stuart

[11] Patent Number: 5,879,240

[45] Date of Patent: Mar. 9, 1999

[54] GOLF TRAINING AID

[76] Inventor: David Stuart, Beechwood Sudbury Hill, Harrow Middlesex HA1 3ND, United Kingdom

[21] Appl. No.: 949,053

[22] Filed: Oct. 10, 1997

[51] Int. Cl.[6] ..... A63B 69/36

[52] U.S. Cl. ..... 473/215; 473/277

[58] Field of Search ..... 473/215, 277

[56] References Cited

U.S. PATENT DOCUMENTS 1,591,524 7/1926 Fuller ..... 473/215

5,390,929 2/1995 Todaro .

5,582,551 12/1996 Bursi ..... 473/215 X

*Primary Examiner*—George J. Marlo

*Attorney, Agent, or Firm*—Elliott N. Kramsky

[57] ABSTRACT

A golf training aid is adapted to be worn at the waist of a user and comprises a base and an engagement member mounted on the base for movement between a first inoperative position in which it lies against the base and a second operative position in which it extends outwardly of the base to be engaged by the arm of the user during the downward part of his golf swing. This teaches him to keep his elbow close to his body at this time.

4 Claims, 3 Drawing Sheets

GOLF TRAINING AID

FIELD OF THE INVENTION

The invention relates to a golf training aid which helps a golfer to move his or her arms in a correct path whilst making a golf shot. More particularly, the invention relates to a golf training aid which encourages a user to keep his right elbow (in the case of a right-handed play) close to his body during his downswing.

DESCRIPTION OF THE RELATED ART

U.S. Pat. No. 5,390,929 (Todaro) describes apparatus for guiding a golf swing which includes an elongated guide member projecting outwardly from a panel attached to a golfer's waist. The elongated guide member includes at least one recess for receiving the golfer's arm for guidance at the start of his swing.

SUMMARY

According to the present invention, there is provided a golf training aid, adapted to be worn at the waist of a user, comprising a base and an engagement member mounted on the base for movement between a first inoperative position in which it lies against the base and a second operative position in which it extends outwardly of the base to be engaged by the arm of the user during a golf swing.

In use, the user engages the engagement member with his elbow during the downward part of his golf swing and this teaches him to keep his elbow close to his body at this time.

DESCRIPTION OF THE PREFERRED EMBODIMENTS

Figure 1:
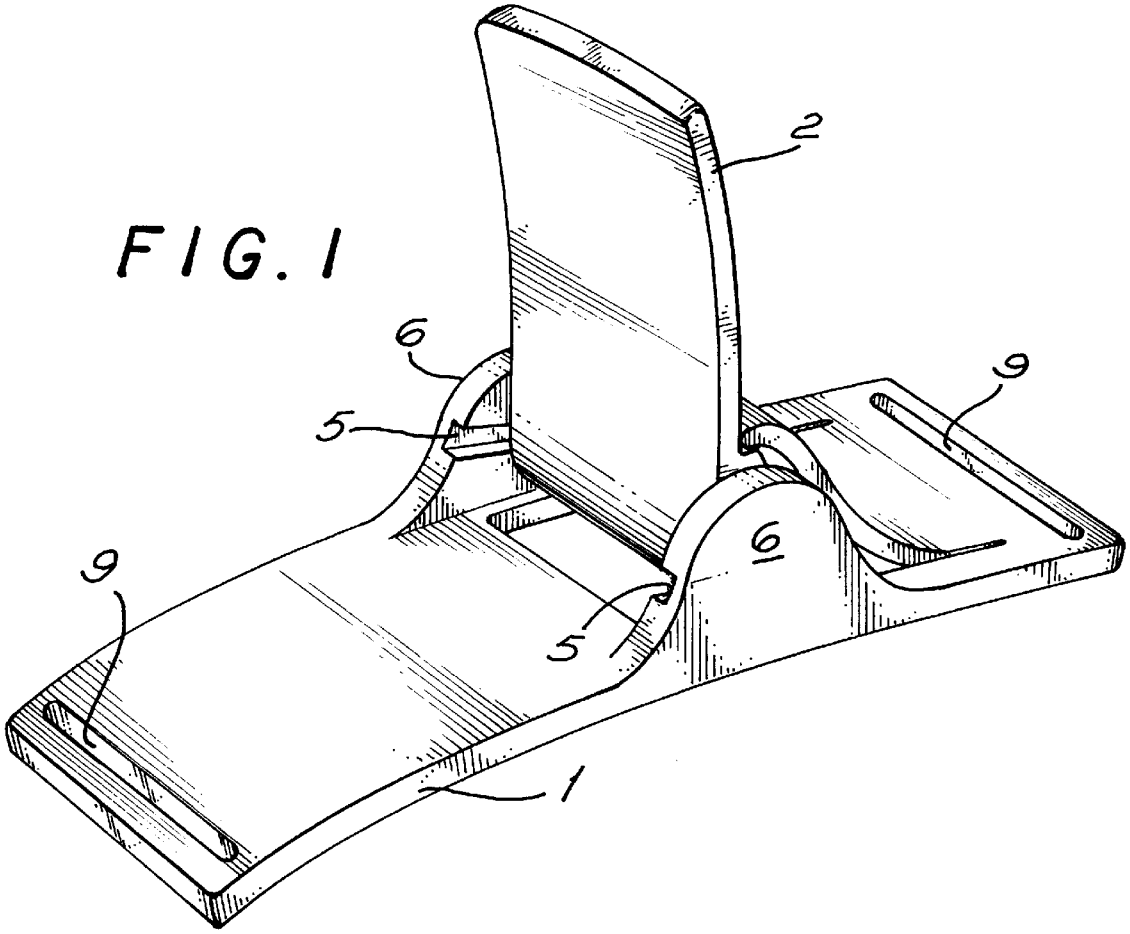
FIG. 1 shows a golf training aid with the engagement member in the operative position.
Figure 2:
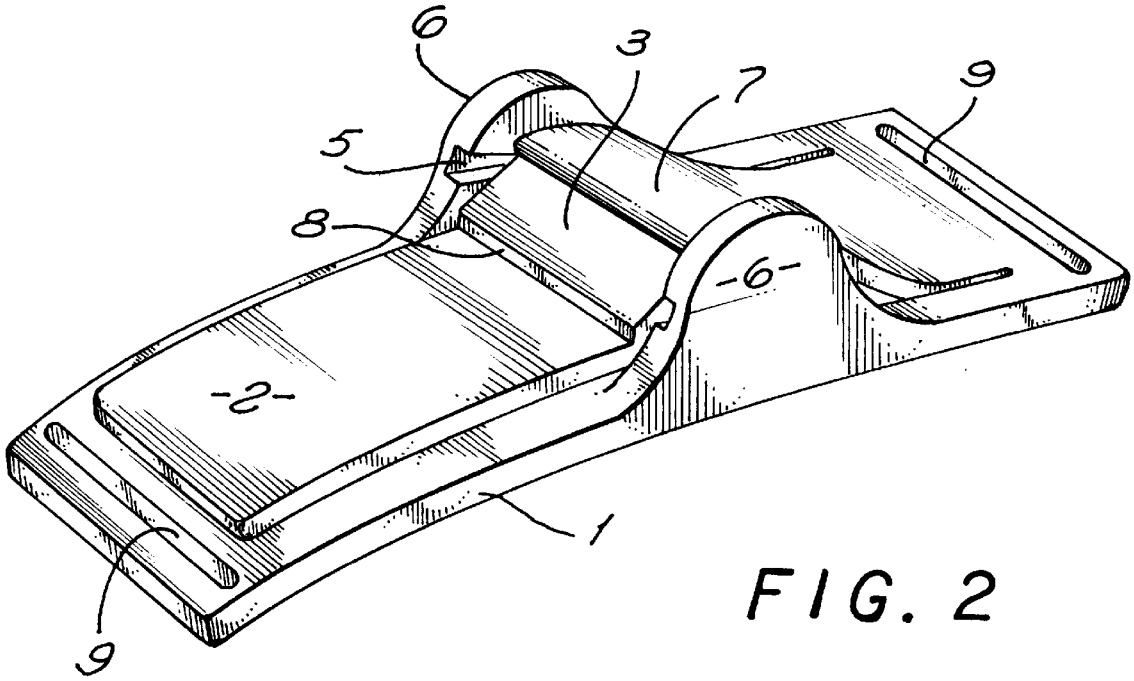
FIG. 2 shows the golf training aid with the engagement member in the inoperative position.
Figure 3:
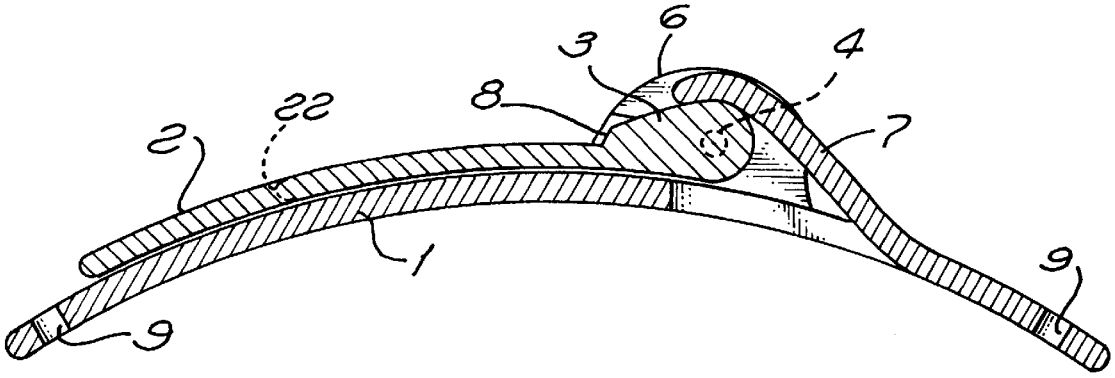
FIG. 3 is a longitudinal section through the golf training aid with the engagement member in the inoperative position.
Figure 4:
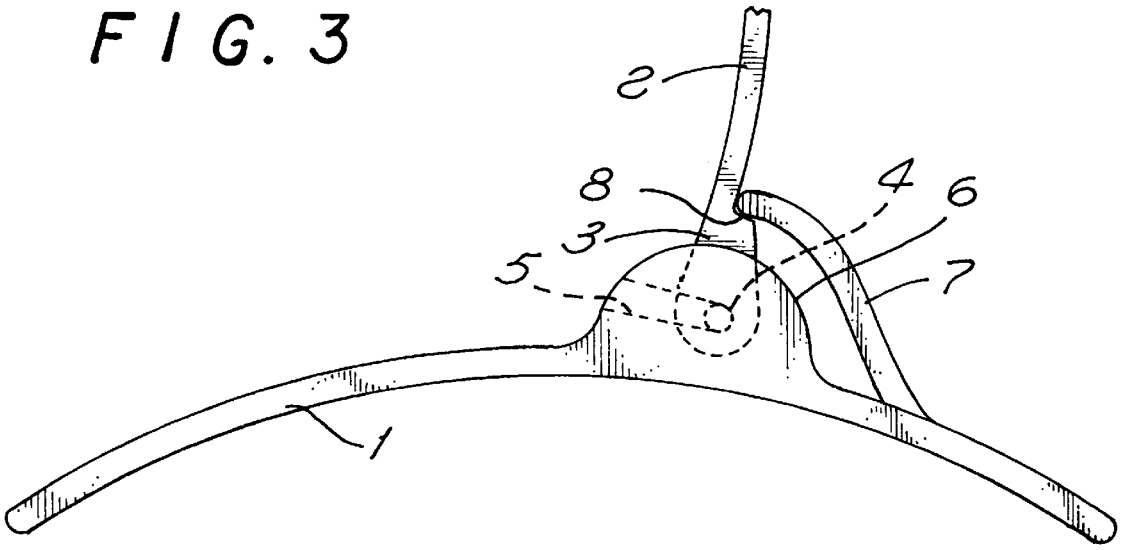
FIG. 4 is a side view of the golf training aid with the engagement member in the operative position.
Figure 5:
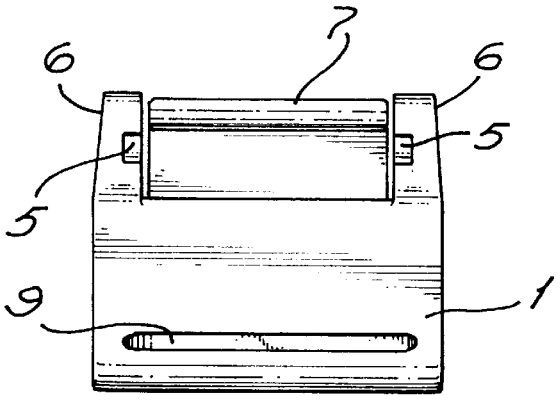
FIG. 5 is an end view (taken from the left hand side of FIG. 4) of the golf training aid with the engagement member removed.

As can be seen in the drawings, the golf training aid comprises a base 1 and an engagement member in the form of a paddle 2. The paddle 2 is generally rectangular and slightly curved along its length and has an enlarged head 3 at one end. Stub axles 4 extend laterally from the head 3 and rest at the ends of slightly tapered grooves 5 formed in the facing surfaces of two ears 6 which stand up from opposite sides of the base 1. The paddle is thus pivotally mounted on the base for movement between the operative position shown in FIGS. 1 and 4, and the inoperative position shown in FIGS. 2 and 3. The length of a shorter paddle 2 is indicated in phantom at 22 in FIG. 3.

A tongue 7, formed integrally with the base 1, acts as a leaf spring and bears resiliently onto the head 3 of the paddle 2 to urge the paddle towards the inoperative position. When the paddle is raised against the action of the tongue 7 to the operative position, however, the free end of the tongue cooperates with a shoulder 8 on the paddle to provide a latch mechanism to hold the paddle 2 in the operative position.

The base 1 has a generally elongate rectangular configuration and, like the paddle 2, is slightly curved along its length. Through slots 9 are formed at ends of the base so that the golf training aid can be connected with one or more straps which enable the golf training aid to be worn at the waist of a user. For example, the golf training aid may be threaded onto a belt.

In operation, the golf training aid is worn at the waist of a user adjacent the right hip in the case of a right-handed golfer and adjacent the left hip in the case of a left-handed golfer. In the inoperative position, the paddle 2 lies flat against the base 2 and extends in the direction towards the front of the user's body.

When the user wishes to make a golf swing, he lifts the paddle 2 manually and moves it into the operative position where it is held by the latch mechanism. The golfer does not engage the golf training aid during his backswing, but during a correct downswing, the golfer's right elbow (in the case of a right-handed player) engages the paddle 2. This causes the release of the latch mechanism and the paddle 2 is returned to the inoperative position under the spring action of the tongue 7 and snaps back against the base 1. This is audible and can be felt at the hip of the user to let him know that he has carried out a correct swing.

Preferably, the base is moulded as a single piece from a suitable plastics materials such as nylon or polypropylene. The paddle 2 may be moulded in the same material or may be made from any other suitable material such as rubber. The paddle is then pushed into position on the base against the resilient action of the tongue.

Figure 6:
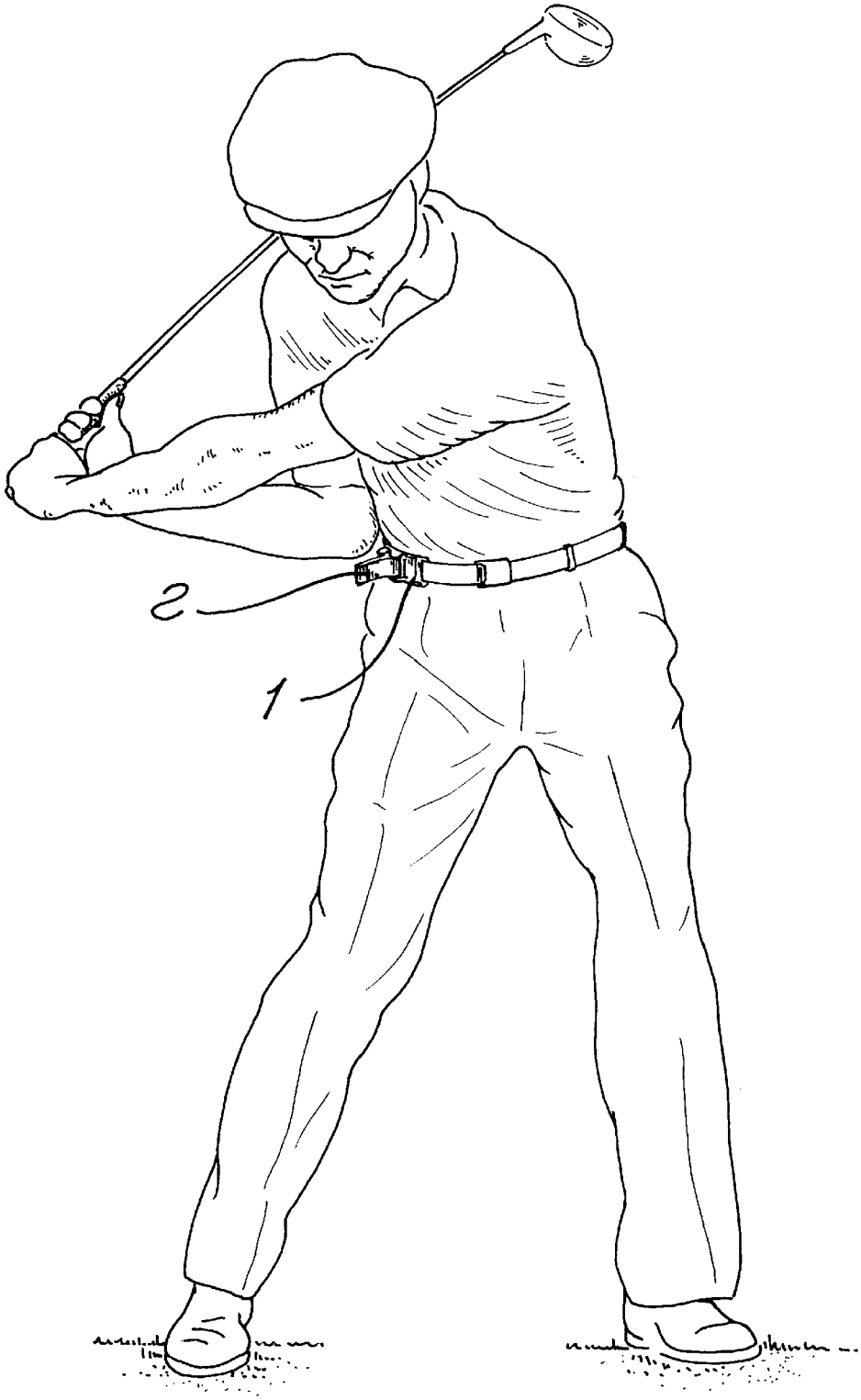
FIG. 6 is an illustration of the present invention in the operative position being worn by a golfer.

FIG. 6 illustrates the golf training aid of the invention in use by a golfer. As can be seen, the base 1 fits snugly to the waist of the golfer. The paddle 2 is shown extending from the base 1, indicating the operative position of the device in which the right elbow of the golfer engages the extended paddle 2 during a proper downswing.

I claim:

1. A golf training aid, adapted to be worn at the waist of a user, comprising a base and an engagement member pivotally mounted on the base for movement between a first inoperative position in which it lies against the base and a second operative position in which it extends outwardly of the base to be engaged by the arm of the user during a golf swing wherein a spring member mounted on the base normally acts on the engagement member to bias it towards the inoperative position and wherein a latch mechanism is provided to overcome the spring member to hold the engagement member in the operative position.

2. A golf training aid according to claim 1, wherein a resilient tongue formed on the base biases the engagement member in the operative position. cooperates with a shoulder on the engagement member to provide the latch mechanism for holding the engagement member in the operative position.

3. A golf training aid according to claim 1, wherein the base has a generally elongate rectangular configuration and is provided at its ends with means for connection to at least one strap so that the golf training aid can be worn at the waist of a user.

4. A golf training aid according to claim 1, further comprising at least one strap for enabling it to be worn at the waist of a user.

* * * * *